US009745929B2

(12) United States Patent
Oohashi

(10) Patent No.: US 9,745,929 B2
(45) Date of Patent: Aug. 29, 2017

(54) FUEL PUMP MODULE

(71) Applicant: DENSO CORPORATION, Kariya, Aichi-pref. (JP)

(72) Inventor: Masaharu Oohashi, Takahama (JP)

(73) Assignee: DENSO CORPORATION, Kariya (JP)

( * ) Notice: Subject to any disclaimer, the term of this patent is extended or adjusted under 35 U.S.C. 154(b) by 57 days.

(21) Appl. No.: 14/469,930

(22) Filed: Aug. 27, 2014

(65) Prior Publication Data

US 2015/0059706 A1 Mar. 5, 2015

(30) Foreign Application Priority Data

Aug. 28, 2013 (JP) ..... 2013-176964

(51) Int. Cl.
*F02M 37/04* (2006.01)
*F02M 37/00* (2006.01)
(Continued)

(52) U.S. Cl.
CPC ..... *F02M 37/0088* (2013.01); *F02M 37/025* (2013.01); *F02M 37/106* (2013.01);
(Continued)

(58) Field of Classification Search
CPC ..... F02M 59/366; F02M 63/0225; F02M 59/466; F02M 57/02; F02B 3/06
(Continued)

(56) References Cited

U.S. PATENT DOCUMENTS 4,879,035 A * 11/1989 Thompson ..... B01D 27/08 210/167.02
5,642,718 A * 7/1997 Nakai ..... F02M 37/22 123/497
(Continued)

FOREIGN PATENT DOCUMENTS

JP EP 1452725 A2 * 9/2004 ..... B01D 35/0273
JP 2004-278487 10/2004
(Continued)

OTHER PUBLICATIONS

Office Action (3 pages) dated Jul. 9, 2015, issued in corresponding Japanese Application No. 2013-176964 and English translation (5 pages).
(Continued)

*Primary Examiner* — Jacob Amick
*Assistant Examiner* — Charles Brauch
(74) *Attorney, Agent, or Firm* — Nixon & Vanderhye P.C.

(57) ABSTRACT

A fuel pump module for a fuel tank prevents electrification of a filter within the fuel pump module. A port injection filter is housed in a filter case that is separate from a pump case that houses a port injection fuel pump. A ground bracket housed in the filter case includes a cylinder part, a first connection part, and a second connection part, which are formed as a single body and made of conductive resin. The cylinder part is disposed inside of the port injection filter. The second connection part is disposed on an opposite side of the bracket relative to the first connection part, where the first connection part is connected with the cylinder part, for the connection to the ground through a ground line. As a result, a static electricity caused by friction of fuel flowing through the filter is discharged to the ground.

11 Claims, 9 Drawing Sheets

(51) Int. Cl.

| | |
|---|---|
| ***F02M 37/02*** | (2006.01) |
| ***F02M 37/10*** | (2006.01) |
| ***F02M 37/18*** | (2006.01) |
| *F02M 37/08* | (2006.01) |
| *F02D 41/30* | (2006.01) |
| *F02D 41/38* | (2006.01) |

(52) U.S. Cl.
CPC ..... *F02M 37/18* (2013.01); *F02D 41/3082* (2013.01); *F02D 41/3845* (2013.01); *F02D 2200/0602* (2013.01); *F02D 2250/31* (2013.01); *F02M 37/08* (2013.01)

(58) Field of Classification Search
USPC ..... 123/506, 497
See application file for complete search history.

(56) References Cited

U.S. PATENT DOCUMENTS

| | | | | |
|---|---|---|---|---|
| 2004/0011129 | A1 | 1/2004 | Gilmour et al. | |
| 2004/0074995 | A1 | 4/2004 | Okada | |
| 2004/0211396 | A1* | 10/2004 | Burhenne | B60K 15/077 123/509 |
| 2005/0241617 | A1 | 11/2005 | Kojima | |
| 2007/0215115 | A1* | 9/2007 | Hazama | F02D 33/003 123/458 |
| 2010/0025318 | A1* | 2/2010 | Berland | B01D 35/26 210/243 |
| 2012/0097273 | A1* | 4/2012 | Uryu | F02D 41/3082 137/565.3 |

FOREIGN PATENT DOCUMENTS

| | | |
|---|---|---|
| JP | 2005-344692 | 12/2005 |
| JP | 2006-125248 | 5/2006 |
| JP | 2009-243330 | 10/2009 |
| JP | 2010-013997 | 1/2010 |

OTHER PUBLICATIONS

U.S. Appl. No. 14/470,198, filed Aug. 27, 2014 in the name of Masaharu Oohashi.
U.S. Appl. No. 14/470,004, filed Aug. 27, 2014 in the name of Masaharu Oohashi.
U.S. Appl. No. 14/470,090, filed Aug. 27, 2014 in the name of Masaharu Oohashi.
U.S. Appl. No. 14/469,965, filed Aug. 27, 2014 in the name of Masaharu Oohashi.

* cited by examiner

FUEL PUMP MODULE

CROSS REFERENCE TO RELATED APPLICATION

The present application is based on and claims the benefit of priority of Japanese Patent Application No. 2013-176964, filed on Aug. 28, 2013, the disclosure of which is incorporated herein by reference.

TECHNICAL FIELD

The present disclosure generally relates to a fuel pump module.

BACKGROUND INFORMATION

Conventionally, a fuel pump module that supplies fuel in a fuel tank to an internal-combustion engine is equipped with a filter that removes foreign substance contained in the fuel. In the fuel pump module, when the fuel passes though the filter, static electricity is generated due to friction between the fuel and the filter. Therefore, the filter is electrically connected with a conductive member that discharges the stored electricity in the filter to other parts. For example, a patent document 1 (i.e., Japanese Patent No.: JP-A-2004-278487) discloses a fuel supply system that includes a fuel pump, a filter for removing foreign substance from the fuel that is discharged from the fuel pump, a ground line for electrically connecting the filter and a ground, and a housing that houses the fuel pump and the filter.

However, the filter of the fuel supply system in the patent document 1 has a ground line made of a conductive material including a carbon particle and the like, for example. Therefore, when the fuel passes through the filter, the carbon particle in the filter may be mixed into the fuel. Further, the electricity stored in the filter may be discharged to the ground through the fuel pump when the fuel pump and the filter are housed in the same housing. However, when the fuel pump and the filter are housed in two separate housings, discharging of the electricity in the filter through the pump to the ground is not possible.

SUMMARY

It is an object of the present disclosure to provide a fuel pump module which prevents an electrification of a fuel filter.

In an aspect of the present disclosure, a fuel pump module supplying fuel in a fuel tank to an internal-combustion engine. The fuel pump module includes a first pump discharging fuel from the fuel tank to an air-intake system of the internal-combustion engine, a first pump housing that houses the first pump, a first filter removing foreign substance from the fuel that is discharged from the first pump, a first filter housing that houses the first filter, and an antistatic unit housed in the first filter housing, made of a conductive material, and connected to a ground. The antistatic unit prevents electrification of the first filter.

In the fuel pump module of the present disclosure, the first pump and the first filter are housed in two separate housings. The first filter housing that houses the first filter also houses an antistatic unit that is made of a conductive material and prevents an electrification of the filter. Therefore, when the first filter is electrified by the fuel passing therethrough, the electricity or the positive/negative electric charge stored in the first filter flows to the ground through the antistatic unit that is connected with the ground. In such manner, the fuel pump module of the present disclosure prevents an electrification of the first filter when the fuel pump is not housed in the first filter housing or when the first filter is made of an insulating material that is not electrically connectable with the ground line.

BRIEF DESCRIPTION OF THE DRAWINGS

Objects, features, and advantages of the present disclosure will become more apparent from the following detailed description made with reference to the accompanying drawings, in which.

DETAILED DESCRIPTION

Hereafter, the embodiment of the present disclosure is described based on the drawings.

One Embodiment

Figure 1:
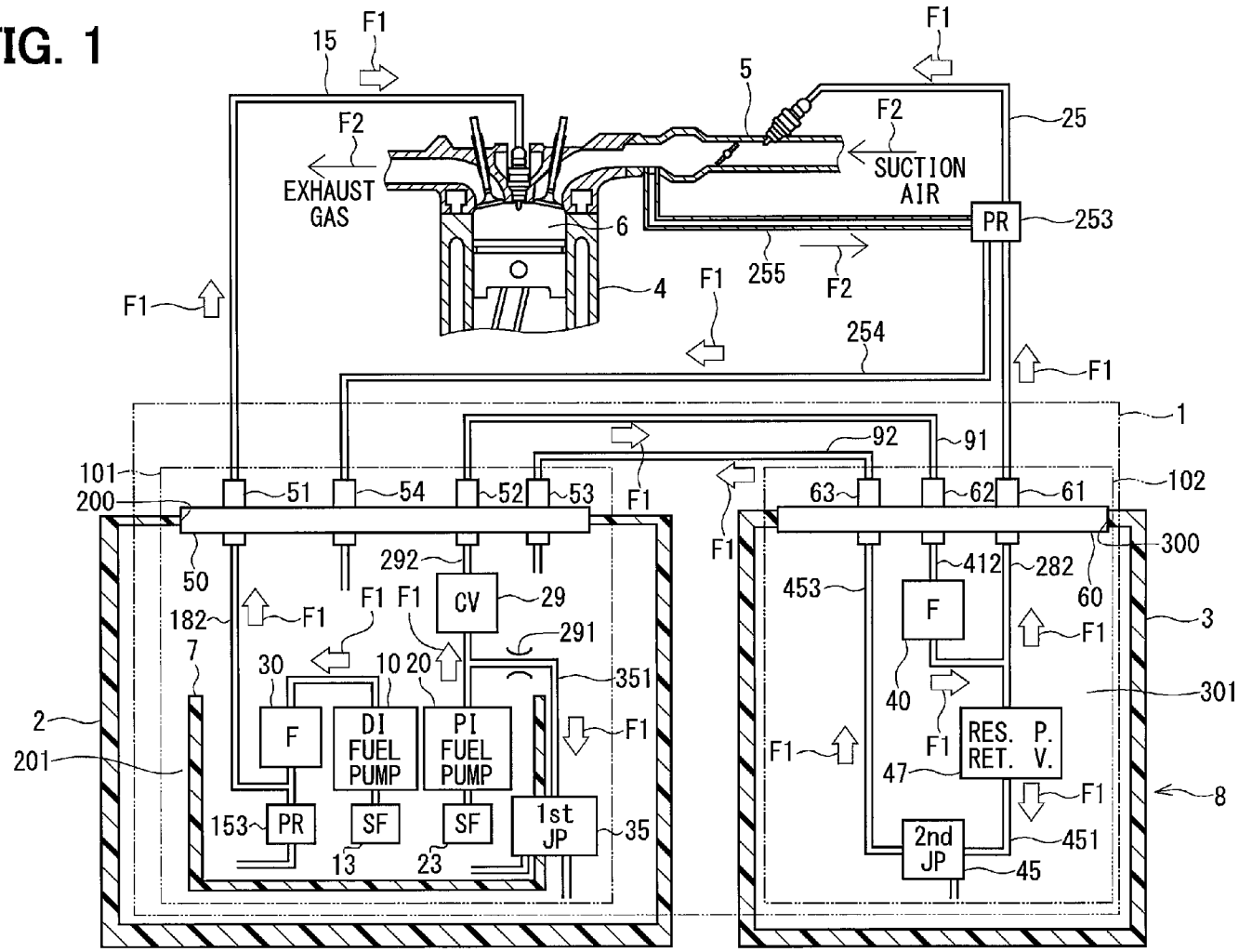
FIG. 1 is a block diagram of a system of a fuel pump module in one embodiment of the present disclosure.

The block diagram explaining a system of a fuel pump module 1 in one embodiment of the present disclosure is shown in FIG. 1. The fuel pump module 1 supplies, to an engine 4, a fuel stored by a fuel tank 8 which has two "fuel reservoir rooms", i.e., a first tank room 201 and a second tank room 301. The fuel pump module 1 supplies, to either one of a combustion chamber 6 of the engine 4 or an air-intake system 5 which is connected to the engine 4, the fuel in different pressures according to a drive state of the engine 4. The fuel pump module 1 is, as shown in FIG. 1, comprised of a first module 101 and a second module 102 together with other parts such as transport pipes 91 and 92 etc. by which the first module 101 and the second module 102 are connected for flowing the fuel back and forth between a first tank 2 and a second tank 3. Further, a white arrow F1 in FIG. 1 shows a flow of the fuel. Further, a solid line arrow F2 in FIG. 1 shows a flow of a gas.

The first module 101 is disposed in the first tank 2. The first module 101 pressurizes the fuel in the first tank 2, and supplies the pressurized fuel to the engine 4, or transports it to the second tank 3. The first module 101 comprises a direct injection suction filter 13 (hereafter designated as a "DI suction filter 13"), a direct injection fuel pump 10 (i.e., hereafter designated as a "DI fuel pump 10"), a port injection suction filter 23 (i.e., hereafter designated as a "PI suction filter 23"), a port injection fuel pump 20 (i.e., hereafter designated as a "PI fuel pump 20"), a direct injection filter 30 (i.e., hereafter designated as a "DI filter 30"), a first jet pump 35, a first flange 50, a subtank 7, and other parts. The DI suction filter 13 is equivalent to a "first suction filter" in the claims. The DI fuel pump 10 is equivalent to a "second pump" in the claims. The PI suction filter 23 is equivalent to a "second suction filter" in claims. The PI fuel pump 20 is equivalent to a "first pump" in the claims. The DI filter 30 is equivalent to a "second filter" in the claims.

Figure 4:
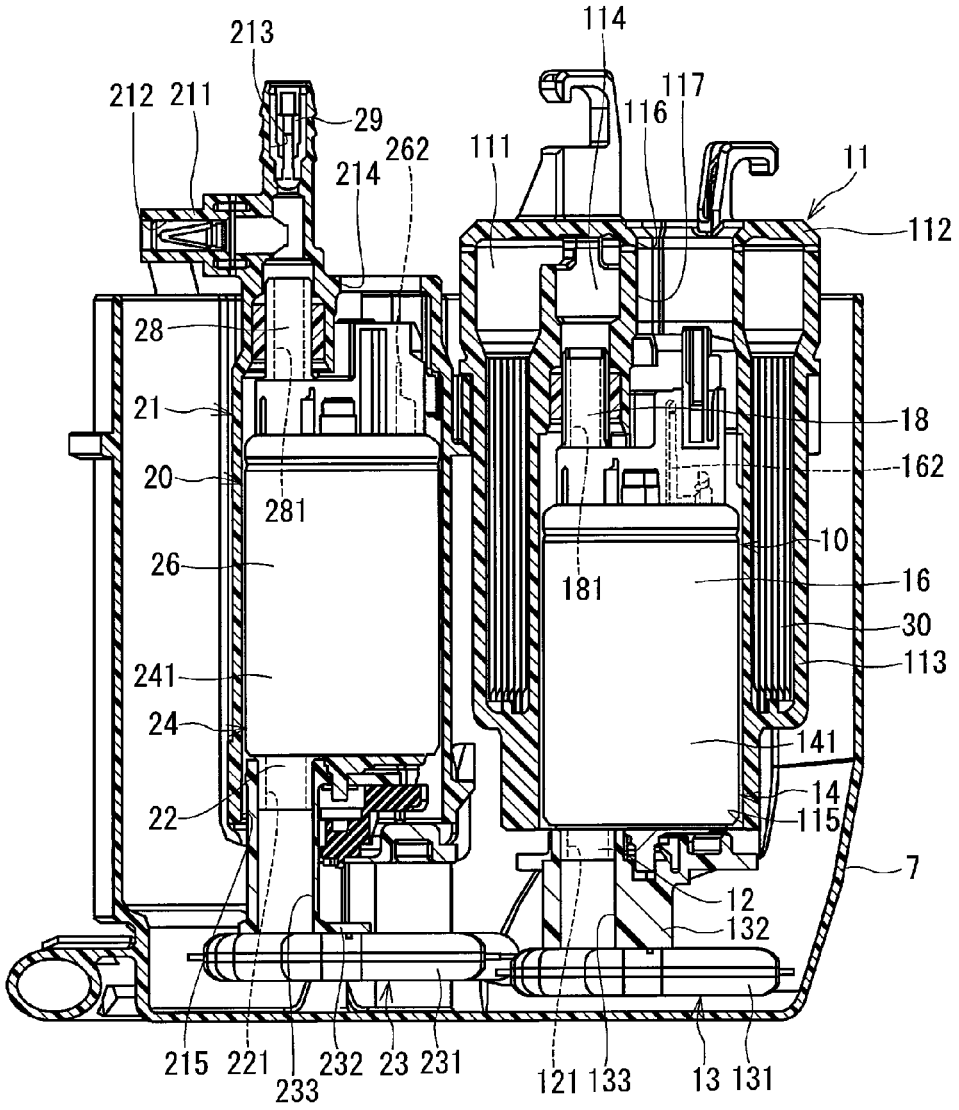
FIG. 4 is a sectional view of the first module in the fuel pump module in one embodiment of the present disclosure.

Referring to FIG. 4, the DI suction filter 13 comprises a saccate element part 131, a cylindrical connection part 132, etc. The DI suction filter 13 removes foreign substance from the fuel in the subtank 7 by using the element part 131. The connection part 132 is disposed at a position between the saccate element part 131 and the suction part 12 of the DI fuel pump 10, and is connected to the suction part 12. The connection part 132 providing a connection port 133 allows a communication between an inside of the element part 131 and a suction port 121 of the suction part 12 of the DI fuel pump 10.

The DI fuel pump 10 is an electromotive pump disposed in the subtank 7 that is accommodated in the first tank 2. The DI fuel pump 10 pressurizes the fuel in the subtank 7 to 500 kPa, for example, and directly supplies the pressurized fuel to the combustion chamber 6 of the engine 4 via a direct injection supply pipe 15 (i.e., hereafter designated as a "DI supply pipe 15") leading to a direct injection supply port 51 (i.e., hereafter designated as a "DI supply port 51") that is disposed on the first flange 50. In the fuel pump module 1 in one embodiment, it is configured that an amount of the fuel supplied from the DI fuel pump 10 to the engine 4 is greater than an amount of the fuel supplied from the PI fuel pump 20 to the engine 4. The DI fuel pump 10 comprises the suction part 12, a pump part 14, a motor part 16, a discharge part 18, and the like. The DI supply port 51 is equivalent to a "second supply port" in the claims.

The suction part 12 is disposed on a filter side (i.e. closer to the DI suction filter 13) of the DI fuel pump 10, and is connected to the pump part 14 of the DI fuel pump 10. The suction part 12 has the suction port 121. The suction port 121 allows communication between an inside of the DI suction filter 13 and an inside of the pump part 14. The suction port 121 is disposed at an away-from-axis position (i.e., a position that is different from a position of an axis of the DI fuel pump 10) and sends the fuel in the subtank 7 via the DI suction filter 13 to the pump part 14.

The pump part 14 comprises an impeller which is not illustrated, a pump case 141 which forms a pump room, in which the impeller is rotatably accommodated, together with other parts. The pump room allows communication between the suction port 121 of the suction part 12 and a discharge port 181 of the discharge part 18. On one side of the pump case 141 close to the DI suction filter 13, a vapor vent port 142 is formed for venting an evaporated fuel in the pump part 14 to an inside of the sub tank 7 (see FIG. 5).

The motor part 16 is a brushless motor which comprises a stator, a rotor, a shaft, and the like, all of which are not illustrated. When an electric power is supplied to a not-illustrated winding which is wound on a cylindrical stator via a wire harness 161 (see FIG. 2) and a power supply terminal 162, a rotor positioned in an inside of the stator rotates together with the shaft. A rotation torque of the shaft is transmitted to the impeller of the pump part 14. In such manner, the impeller of the pump part 14 rotates, the fuel in the pump room is pressurized, and the pressurized fuel is sent to the discharge part 18.

The discharge part 18 is disposed on an opposite side of the suction part 12 relative to the pump part 14 and the motor part 16. The discharge part 18 has the discharge port 181 which allows communication between an inside of the pump part 14 and an inside of the pump case 11. The fuel pressurized by the pump part 14 is sent to a fuel passage 111 that is formed in an inside of the pump case 11 via the discharge port 181.

The pump case 11 is a cylindrical member having a bottom, which is made of resin. The pump case 11 comprises a bottom part 112, a side part 113, a connection part 119, and the like. The DI fuel pump 10 and the DI filter 30 are housed in an inside of the pump case 11, which is equivalent to a "second pump housing."

The bottom part 112 is formed substantially in a disk shape from resin. A through hole 116 is disposed on the bottom part 112 substantially in parallel with an axis of the DI fuel pump 10. The through hole 116 accepts a connector to be electrically connected to the power supply terminal 162 of the motor part 16 inserted therein.

Referring to FIG. 4, the side part 113 has (i) a cylindrical space with a bottom, or a one-end-closed cylinder, with two openings, i.e., an opening 117 in communication with the through hole 116 of the bottom part 112 and an opening 115 that is formed on a filter side that is close to the DI suction filter 13, and (ii) a donut shape space, or a ring shape space, that is positioned on a radially-outer portion of the cylindrical space. In the one-end-closed cylinder, the DI fuel pump 10 is housed. The DI fuel pump 10 is housed in the one-end-closed cylinder through the opening 115. Further, through the opening 117, a connector that is electrically connected with the power supply terminal 162 is housed. At a position that corresponds to the discharge port 181 of the side part 113, a connection chamber 114 is formed for communication between the discharge port 181 and the fuel passage 111. The fuel discharged from the discharge port 181 flows through the connection chamber 114 and is sent into the fuel passage 111.

In the donut shape space of the side part 113, the DI filter 30 is housed substantially in a cylindrical shape. The DI filter 30 is made of a conductive resin which does not contain carbon, for example, and removes foreign substance from the fuel that is discharged from the discharge port 181. The fuel flowing through the DI filter 30 is sent into the connection part 119 that is disposed on a radially-outer portion of the pump case 11.

The connection part 119 is disposed on a radially-outer portion of the side part 113, and houses a pressure regulating valve 153. The pressure of the fuel sent to the connection part 119 is adjusted to a desired value by the pressure regulating valve 153. The pressure adjusted fuel is then sent to an outside of the first tank 2 via a supply pipe 182 (see FIG. 1) and the DI supply port 51 that is disposed on the first flange 50.

The PI suction filter 23 comprises a saccate element 231, a connection part 232 substantially in a cylindrical shape, and the like. The PI suction filter 23 removes foreign substance from the fuel in the subtank 7 by using the element 231. The connection part 232 is disposed at a position between the element 231 and a suction part 22 of the PI fuel pump 20, and is connected to the suction part 22. A connection port 233, which is provided by the connection part 232, allows communication between an inside of the element 231 and a suction port 221 which is a part of the suction part 22 of the PI fuel pump 20.

The PI fuel pump 20 is an electromotive pump disposed in the subtank 7 of the first tank 2 similar to the DI fuel pump 10. The PI fuel pump 20 pressurizes the fuel in the subtank 7 to an arbitrary pressure level between 350 to 500 kPa, for example, and sends the fuel to the second tank 3 via a transport pipe 91 leading to a transport port 52 that is disposed on the first flange 50, and, at the same time, supplies the pressurized fuel to the first jet pump 35 that is mentioned later. The PI fuel pump 20 comprises the suction part 22, a pump part 24, a motor part 26, a discharge part 28, and the like.

The suction part 22 is disposed on a filter side of the PI fuel pump 20, close to the PI suction filter 23, of the PI fuel pump 20, and is connected to the pump part 24 of the PI fuel pump 20. The suction part 22 has the suction port 221. The suction port 221 allows communication between an inside of the PI suction filter 23 and an inside of the pump part 24. The suction port 221 is disposed at an away-from-axis position, i.e., a position that is different from an axis of the PI fuel pump 20, and sends the fuel in the subtank 7 via the PI suction filter 23 to the pump part 24.

The pump part 24 comprises an impeller which is not illustrated, a pump case 241 which forms a pump room, in which the impeller is rotatably accommodated, together with other parts. The pump room allows communication between the suction port 221 of the suction part 22 and a discharge port 281 of the discharge part 28.

The motor part 26 is a brushless motor which includes a stator, a rotor, a shaft, and the like, all of which are not illustrated. When an electric power is supplied to a not-illustrated winding which is wound on a cylindrical stator via a wire harness 261 (see FIG. 2) and a power supply terminal 262, a rotor provided in an inside of the stator rotates together with the shaft. A rotation torque of the shaft is transmitted to the impeller of the pump part 24. In such manner, the impeller of the pump part 24 rotates, the fuel in the pump room is pressurized, and the pressurized fuel is sent to the discharge part 28.

The discharge part 28 is disposed on an opposite side of the suction part 22 relative to the pump part 24 and the motor part 26. The discharge part 28 has the discharge port 281 which allows communication between an inside of the pump part 24 and an inside of the pump case 21. The discharge part 28 is connected to a connection part 211 that is formed in an inside of the pump case 21. The fuel pressurized by the pump part 24 is sent to a connection part 212 through the discharge port 281.

The pump case 21 is a cylindrical member having a bottom, which is made of resin. On one side of the pump case 21 closer to the suction filter 23, an opening 215 is formed. The PI fuel pump 20 is inserted into an inside of the pump case 21 through the opening 215. The pump case 21 is equivalent to a "first pump housing" in the claims.

The connection part 211 disposed on an opposite side of the pump case 21 relative to the suction filter 23 has a flow passage that branches into two directions. One of the two branches, i.e., a flow passage 212, communicates with an inside of the first jet pump 35 via a supply pipe 351 (see FIG. 1 and FIG. 2) having an orifice 291. The other one of the two branches, i.e., a flow passage 213 houses a non-return valve 29 that regulates a flow of the fuel in one way. The fuel flowing in the other passage 213 is sent to an outside of the first tank 2 via a transport pipe 292 (see FIG. 1 and FIG. 2) and the transport port 52 disposed on the first flange 50.

At a position on an opposite side of the pump case 21 that is opposite to the suction filter 23, a through hole 214 is formed, which is a different position from the connection part 211. Through the through hole 214, a connector that is electrically connected with a power supply terminal 262 of the motor part 26 is inserted/installed.

Figure 2:
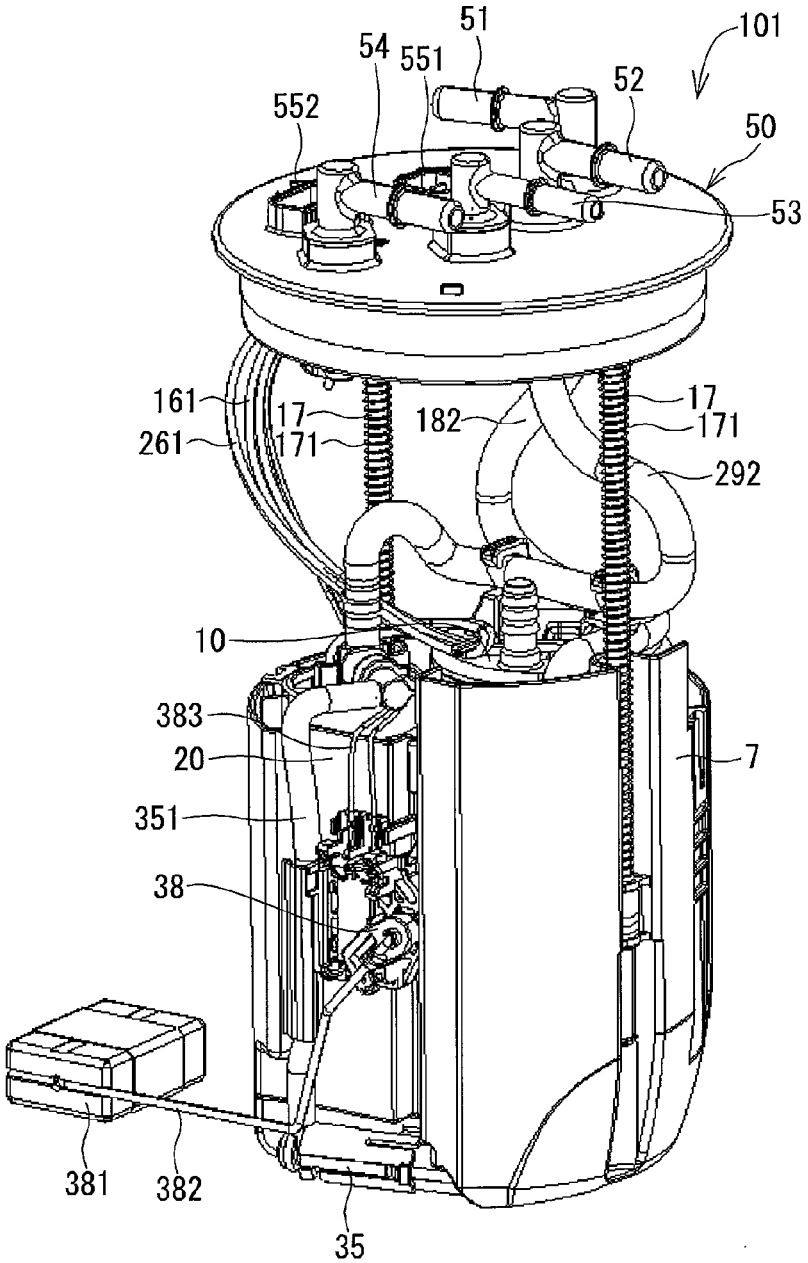
FIG. 2 is a perspective view of a first module in the fuel pump module in one embodiment of the present disclosure.

As shown in FIG. 2, the first jet pump 35 is disposed on the other end of the module 101 relative to the first flange 50, at a radially-outer portion position of the subtank 7. The first jet pump 35 introduces the fuel from the first tank room 201 to the subtank 7 with a help of the pressure of the discharged fuel from the PI fuel pump 20.

Figure 3:
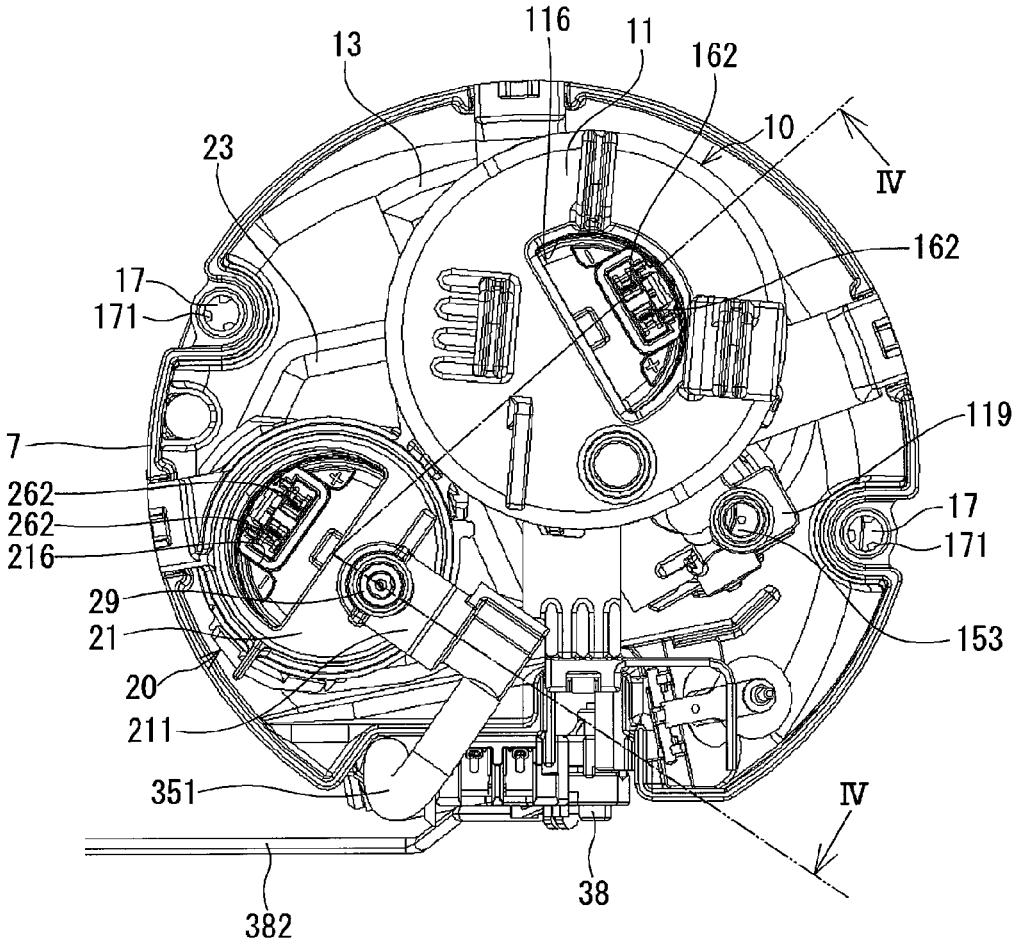
FIG. 3 is a top view of the first module in the fuel pump module in one embodiment of the present disclosure.

A sender gauge 38 is disposed at a radially-outer portion of the subtank 7, as shown in FIGS. 2 and 3. The sender gauge 38 is connected with a float 381 via an arm 382. When the float 381 moves according to a change of a fuel level, the arm 382 rotates, and the fuel level is detected based on a detection of the rotation amount of the arm 381 by the sender gauge 38. The sender gauge 38 outputs a fuel-level detection signal via a wire harness 383 and the first flange 50 to a non-illustrated electrical control unit (i.e., hereafter an "ECU") which is disposed externally to the module 101.

The first flange 50 is formed in a disk shape, and is positioned on an opening 200 of the first tank 2, which is "one opening" and serves as a cover of the opening 200 (see FIG. 1). A transport port 53 through which the fuel flows from the second tank 3 to the subtank 7 is provided on the first flange 50. A reflux port 54 which allows a reflux of the fuel flowing from a pressure regulating valve 253 disposed in a port injection supply pipe 25 (i.e., hereafter a "PI supply pipe 25") back to the subtank 7 is also provided on the first flange 50. In addition, the DI supply port 51 and the transport port 52 are also provided on the first flange 50. Further, on the first flange 50, an external connector 551 and an external connector 552 are disposed on the first flange 50. The external connector 551 is electrically connected to the wire harnesses 161 and 261 and supplies an electric power to the DI fuel pump 10 and the PI fuel pump 20. The external connector 552 outputs to an outside of the module 1 a signal of the fuel level which is detected by the sender gauge 38 via the wire harness 383.

The subtank 7 is formed in a bottom-closed cylindrical shape and is made from resin. The subtank 7 houses the DI fuel pump 10, the PI fuel pump 20, and the like, as mentioned above, and, on a radially-outer portion of the subtank 7, the first jet pump 35 and the sender gauge 38 are disposed.

As shown in FIG. 2, the first flange 50 and the subtank 7 are connected by two shafts 17 so that a relative position of the two (i.e., the flange 50 and the subtank 7) is changeable. On a radially-outer portion of the shaft 17, a spring 171 biasing the first flange 50 and the subtank 7 away from each other is disposed. Thereby, the subtank 7 is pressed against a bottom of the first tank 2.

The second module 102 is disposed in the second tank 3. The second module 102 removes foreign substance from the fuel that is sent from the first tank 2 and supplies the fuel to the engine 4, and/or transports the fuel in the second tank 3 to the first tank 2 with a help of the pressure of the fuel that is sent from the first tank 2. The second module 102 is provided with a port injection filter 40 (i.e., hereafter a "PI filter 40"), a filter case 41, an ground bracket 44, a residual pressure maintenance valve 47, a second jet pump 45, a second flange 60, and the like. The PI filter 40 is equivalent to a "first filter" in the claims.

The PI filter 40 is substantially formed in a cylindrical shape, and is housed in the filter case 41 that has the same shape as the pump case 11 of the DI fuel pump 10. More practically, the PI filter 40 is housed in a donut shape space 415, which is an outer periphery of the filter case 41. The PI filter 40 is, for example, made from an insulating material which does not contain conductive particles such as carbon or the like. The PI filter 40 removes foreign substance from the fuel that is sent from the first tank 2.

Figure 7:
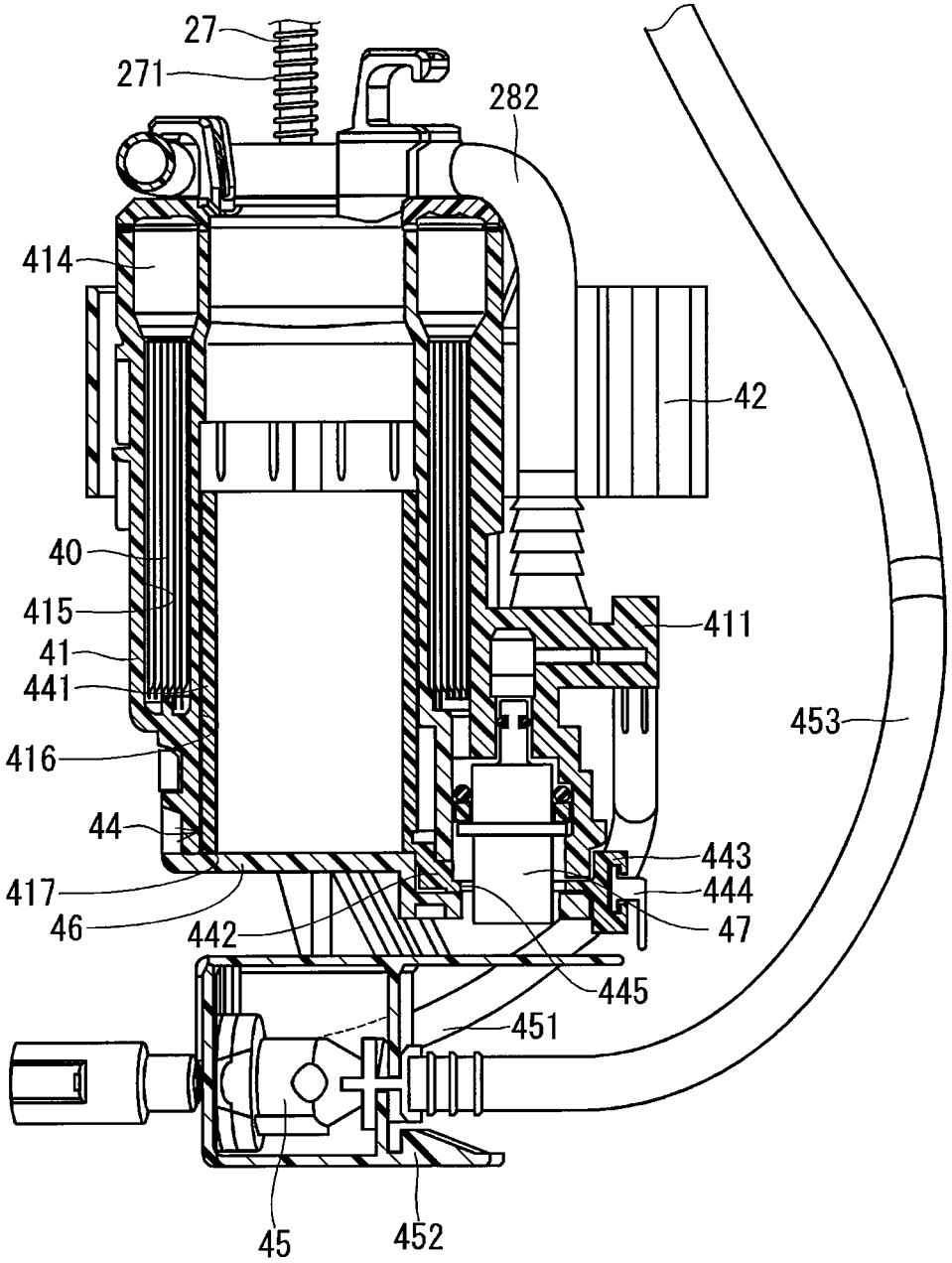
FIG. 7 is a sectional view of the second module in the fuel pump module in one embodiment of the present disclosure.
Figure 8:
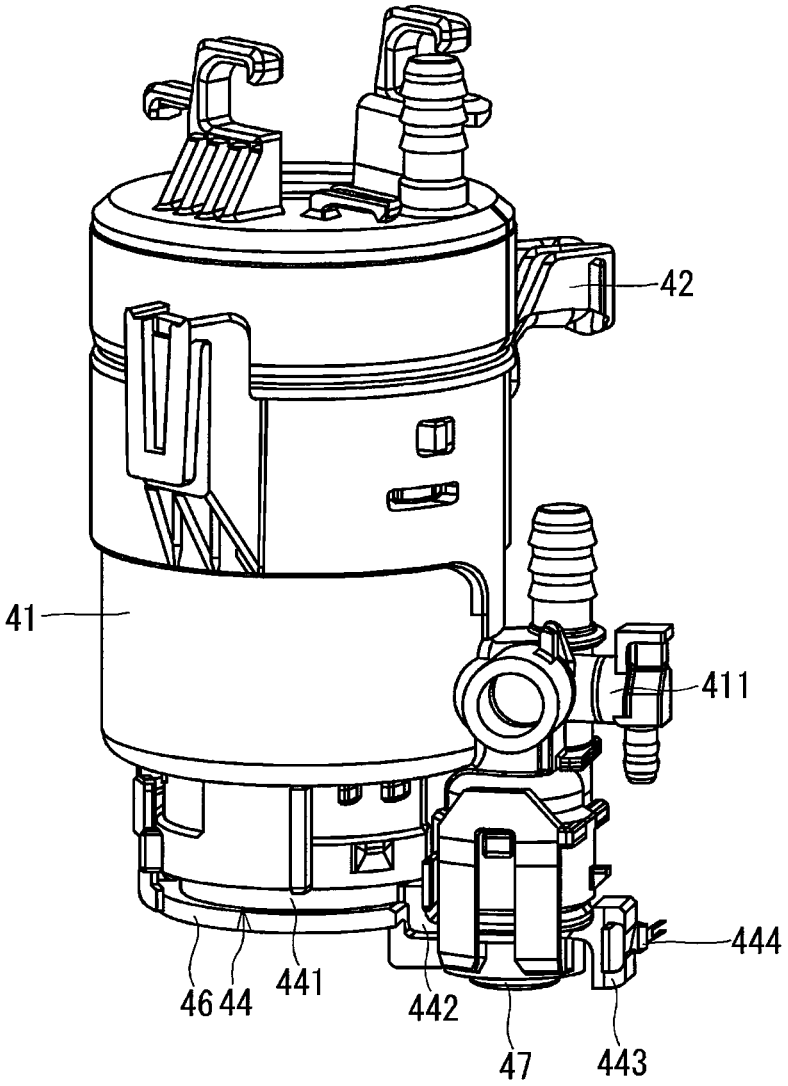
FIG. 8 is a perspective view of a pump case of the second module of the fuel pump module in one embodiment of the present disclosure.

The filter case 41 is supported by an outer bracket 43 through a ring-shape inner bracket 42 that has a ring shape. In a radially-inner portion of the donut shape space 415 in the filter case 41, a column shape space 416 is provided. The column shape space 416 houses, as shown in FIG. 7, a ground bracket 44. The filter case 41 is equivalent to a "first filter housing" in the claims.

Figure 9:
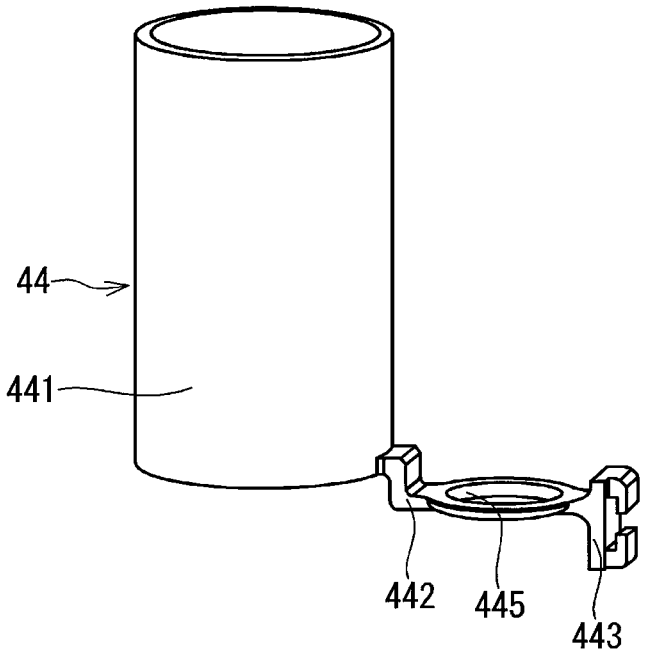
FIG. 9 is a perspective view of a ground bracket of the fuel pump module in one embodiment of the present disclosure.

The ground bracket 44 comprises a cylinder part 441, a first connection part 442, and a second connection part 443, as shown in FIG. 9. In the fuel pump module 1 of one embodiment, the cylinder part 441, the first connection part 442, and the second connection part 443 are formed as a single body (i.e., an integrated, unified, and linked body) from a conductive resin by the injection molding, for example. In the filter case 41, the ground bracket 44 serving as an "antistatic unit" is housed in an insulating state, i.e., the ground bracket 44 is insulated from the PI filter 40, and a position of the ground bracket 44 is fixed relative to the filter case 41 by a support member 46.

The cylinder part 441 is formed substantially in a cylindrical shape. The cylinder part 441 is inserted into the filter case 41 via an opening 417 which communicates with the column shape space 416 in the filter case 41.

The first connection part 442 is formed substantially in a ring shape, and is provided on one end of the cylinder part 441 close to the second jet pump 45. The first connection part 442 is electrically connected with the residual pressure maintenance valve 47, and the residual pressure maintenance valve 47, which is described later in detail, is inserted into a through hole 445 that is formed substantially at the center of the first connection part 442, as shown in FIG. 7. On the other side of the PI filter 40 relative to the first connection part 442, a second connection part 443 is provided.

The second connection part 443 has a ground line 444 that is connected to the ground via the second flange 60. Through the ground line 444, the cylinder part 441 of the ground bracket 44 is connected to the ground.

The filter case 41 has, disposed thereon, a transport pipe 412 and a transport port 413, which introduce the fuel from the first tank 2 via a transport port 62 on the second flange 60 into an inside of the case 41. The fuel introduced into the filter case 41 through the transport port 413 passes a fuel passage 414 and the PI filter 40 in an inside of the filter case 41. The fuel flowing through the PI filter 40 is supplied to the air-intake system 5 of the engine 4 via a supply pipe 282, a port injection supply port 61 (i.e., hereafter a "PI supply port 61") disposed on the second flange 60, and the PI supply pipe 25 connected to the PI supply port 61. Further, a part of the fuel which passes the PI filter 40 is introduced into the residual pressure maintenance valve 47 that is housed in a radially-outer portion of the filter case 41. The PI supply port 61 is equivalent to a "first supply port" in the claims.

The residual pressure maintenance valve 47 is housed in a connection part 411 disposed on a radially-outer portion of the filter case 41, as shown in FIG. 7. The residual pressure maintenance valve 47 serving as a "pressure regulating valve", maintains a pressure of the fuel in an inside of the PI filter 40, which is disposed on an upstream side of the valve 47, at a certain level such as 320 kPa, for example, and prevents the fuel in the PI filter 40 from evaporating. The fuel flowing through the residual pressure maintenance valve 47 is sent to the second jet pump 45 through a supply pipe 451.

The second jet pump 45 is housed in a subtank 452 that is disposed on an opposite side of the second flange 60 relative to the outer bracket 43 (i.e., an opposite end of the module 102 relative to the second flange 60). The second jet pump 45 is a so-called push-down type jet pump, and suctions the fuel from the second tank 3 with a help of the pressure of the fuel sent from the residual pressure maintenance valve 47. The fuel suctioned by the second jet pump 45 is sent to an outside of the second tank 3 via a transport pipe 453 and a transport port 63 that is disposed on the second flange 60.

Figure 5:
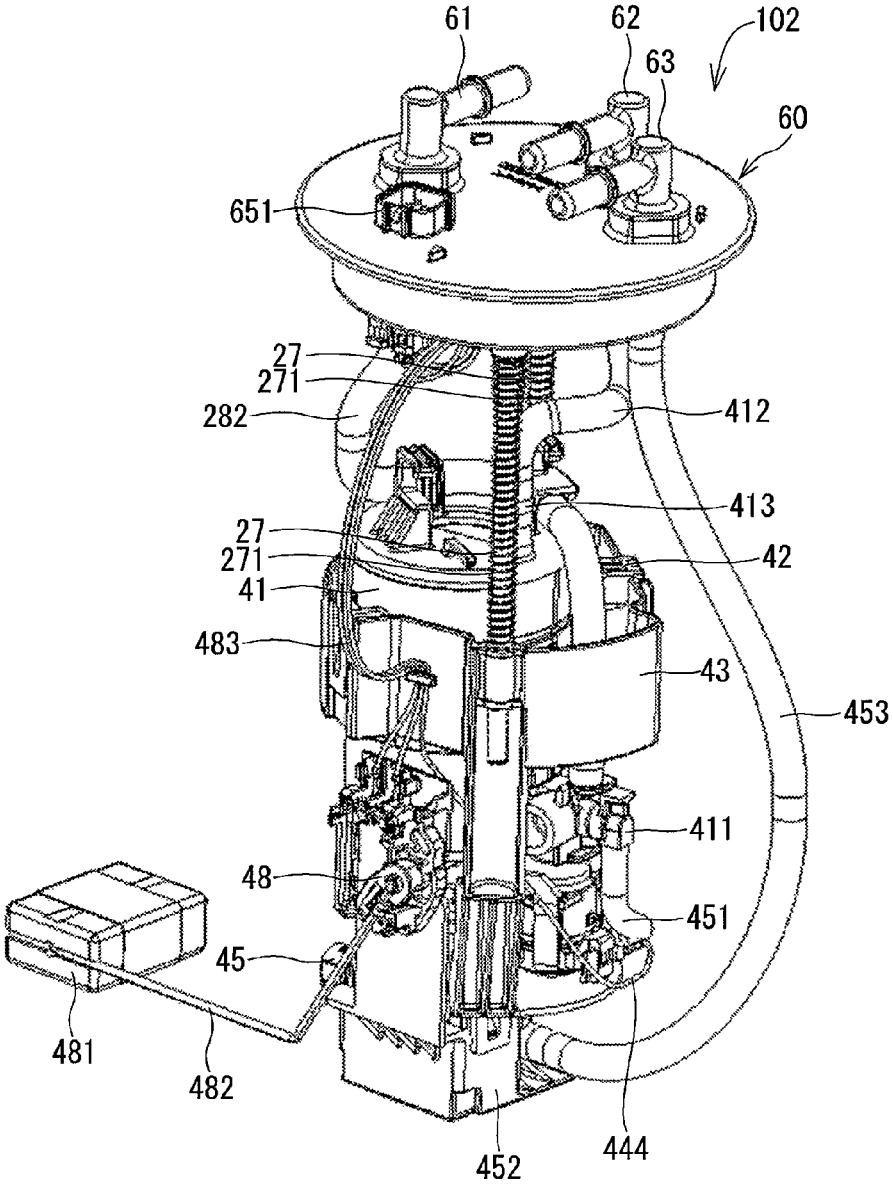
FIG. 5 is a perspective view of a second module in the fuel pump module in one embodiment of the present disclosure.
Figure 6:
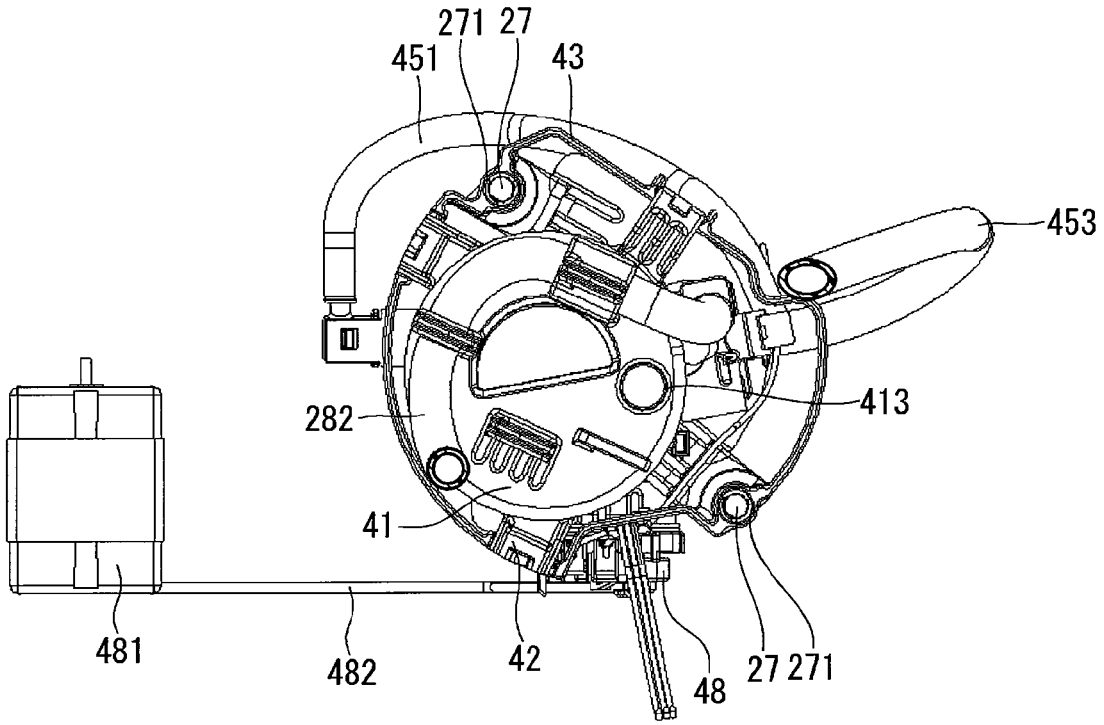
FIG. 6 is a top view of the second module in the fuel pump module in one embodiment of the present disclosure.

A sender gauge 48 is disposed on a radially-outer portion of the filter case 41, as shown in FIG. 5. The sender gauge 48 is connected to a float 481 via an arm 482. When the float 481 moves according to a change of a fuel level, the arm 482 rotates, and a fuel level is detected based on a detection of the rotation amount of the arm 482 by the sender gauge 48. The sender gauge 48 outputs a fuel-level detection signal via the second flange 60 to the ECU that is external to the module 102.

The second flange 60 is formed in a disk shape, and it is put on an opening 300 of the second tank 3, which is an "other opening", and serves as a cover of the opening 300. On the second flange 60, the PI supply port 61 as well as transport ports 62 and 63 are disposed. Further, on the second flange 60, an output terminal which outputs a fuel level signal detected by the sender gauge 48 via a wire harness 483 to an outside of the module 102 and an external connector 651 that has a ground terminal for a ground connection of the ground line 444 of the ground bracket 44 are provided.

In the fuel pump module 1, the transport port 52 of the first flange 50 and the transport port 62 of the second flange 60 are connected with each other by the transport pipe 91 through which the fuel flows from the first tank 2 to the second tank 3. Further, the transport port 53 of the first flange 50 and the transport port 63 of the second flange 60 are connected with each other by the transport pipe 92 through which the fuel flows from the second tank 3 to the first tank 2. In such manner, the fuel in the second tank 3 is transported to the first tank 2 in which two fuel pumps are provided, and the fuel in both of the first tank 2 and the second tank 3 is securely supplied to the engine 4.

The second flange 60 and the filter case 41 are connected by two shafts 27 as shown in FIG. 5. On a radially-outer portion of the shaft 27, a spring 271 biasing the second flange 60 and the filter case 41 away from each other is disposed. Thereby, the filter case 41 is pressed against a bottom of the second tank 3 by the spring 271 which biases the case 41 away from the second flange 60.

The operation of the fuel pump module 1 is described in the following.

If an electric power is supplied from outside of the module 1 to the DI fuel pump 10 and the PI fuel pump 20 via the external connector 551, the DI fuel pump 10 and the PI fuel pump 20 are driven, and the fuel in the subtank 7 is suctioned via the suction filters 13 and 23 and is pressurized.

In the DI fuel pump 10, foreign substance is removed from the fuel that is discharged from the pump part 14 by the DI filter 30 that is housed in the pump case 11. After the removal of foreign substance from the fuel by the DI filter 30, the pressure of the fuel is adjusted to a suitable value by the pressure regulating valve 153, and the fuel having a suitable pressure is directly supplied to the combustion chamber 6 of the engine 4 through the supply pipe 182, the DI supply port 51 on the first flange 50 and the supply pipe 15.

On the other hand, in the PI fuel pump 20, the fuel discharged from the pump part 24 is in part transported into the second tank 3 through the transport pipe 292, the transport port 52 on the first flange 50, the transport pipe 91, the transport port 62 on the second flange 60, and the transport pipe 412, after flowing through a non-return valve 49. Further, the fuel discharged from the pump part 24 is in part supplied to the first jet pump 35 through the supply pipe 351. The first jet pump 35 introduces the fuel from the first tank 2 into the subtank 7 with a help of the pressure of the supplied fuel.

Foreign substance is removed from the pressurized fuel, which is transported from the first tank 2 to the second tank 3 through the transport pipe 91, by the PI filter 40. The fuel flowing through the PI filter 40 is in part supplied to the air-intake system 5 of the engine 4 through a supply pipe 282, the PI supply port 61 on the second flange 60, and the PI supply pipe 25. At this time, the pressure of the supplied fuel flowing through the PI supply pipe 25 is adjusted by the pressure regulating valve 253 according to the pressure of a suction air introduced via a vent pipe 255 which is in communication with the air-intake system 5, for example. The fuel not going to be supplied to the air-intake system 5, due to the pressure adjustment, returns to an inside of the first tank 2 via a return pipe 254 and the reflux port 54 on the first flange 50.

Further, the fuel flowing through the PI filter 40 is in part supplied to the second jet pump 45 through the residual pressure maintenance valve 47 and the supply pipe 451. The second jet pump 45 sends the fuel from the second tank 3 to the subtank 7 via the transport pipe 453, the transport port 63 on the second flange 60, the transport pipe 92, and the transport port 53 on the first flange 50 with a help of the pressure of the supplied fuel. Thereby, the fuel of the second tank room 301 is pressurized by the DI fuel pump 10 and the PI fuel pump 20 in the first tank 2, and is supplied to the engine 4.

The fuel pump module 1 of one embodiment has two fuel pumps having respectively different discharge pressures, two filters, and two supply ports corresponding to the two fuel pumps. The fuel pump module 1 is disposed in the fuel tank 8 which has two fuel reservoir rooms, and the PI filter 40 is housed in the filter case 41 that is different from the pump case 21 in which the PI fuel pump 20 is housed. In such a structure, the electric charge stored in the PI filter 40 due to the flowing of the fuel therethrough is discharged to the ground through the ground bracket 44 that is housed in the filter case 41. Thereby, electrification of the PI filter 40 is prevented, without putting the PI filter 40 in the same case as the fuel pump.

Further, the first connection part 442 of the ground bracket 44 is electrically connected to the residual pressure maintenance valve 47. Thereby, the electric charge of the ground bracket 44 is discharged to the ground via the residual pressure maintenance valve 47. Thus, electrification of the PI filter 40 is effectively prevented.

The PI filter 40 is made of an insulating material which does not contain any carbon particle or the like. Thereby, a conductive particle, which is sprinkled in the filter for providing conductivity for the filter when the filter is directly connected with the ground line or the like, will not fall from the filter, thereby not causing a contamination of the fuel with such conductive particle.

The filter case 41 is made in the same shape as the pump case 11 that houses the DI fuel pump 10 and the like. Thereby, the number (i.e., the variation) of components of the fuel pump module 1 is reduced.

The ground bracket 44 is molded by the conductive resin to which an injection molding is applicable. Thereby, the dimension error of the ground bracket 44 is reduced, and the manufacturing cost of the bracket 44 is reduced.

Other Embodiments (a) According to the above-mentioned embodiment, the fuel tank is described as having a split type fuel tank, in which a first tank and a second tank communicate with each other through a transport pipe. However, the configuration of the fuel tank is not limited to the above. For example, the fuel tank may have a saddle shape, and a bottom part of a "fuel reservoir room" for storing fuel may be split into two parts. Further, the number of the fuel reservoir rooms is not limited to two. That is, the number of the reservoir rooms may be three or more.

(b) According to the above-mentioned embodiment, the ground bracket is described as provided in an inside of the PI filter. However, an installation position of the ground bracket relative to the PI filter is not limited to the above. That is, the ground bracket may be provided on a radially-outer portion of the PI filter.

(c) According to the above-mentioned embodiment, the ground bracket is described as formed by an injection molding. Thereby, the ground bracket may be molded in other shapes, other than the cylindrical shape described above. That is, the ground bracket having a special shape may be manufacturable.

(d) According to the above-mentioned embodiment, the ground bracket is described as connected to the ground through the ground line while electrically connected with the residual pressure maintenance valve. However, the ground bracket may be connected to other parts. That is, the ground bracket may be connected to a negative line of the sender gauge wire harness which is connected to the ground. In such manner, electrification of the PI filter may more effectively be prevented.

The present disclosure is not necessarily limited to the above-described embodiments, but may have other variations other than the above, as long as the fuel pump module is realized as pertaining within the gist of the idea of the disclosure.

What is claimed is:

1. A fuel pump module supplying fuel in a fuel tank to an internal-combustion engine, the fuel pump module comprising: a first pump discharging fuel from the fuel tank to an air-intake system of the internal-combustion engine; a first pump housing that houses the first pump; a first filter removing foreign substance from the fuel that is discharged from the first pump; a first filter housing that houses the first filter; and an antistatic unit comprising a cylinder part that is housed entirely inside the first filter housing, made of a conductive material, and connected to a ground, wherein the antistatic unit prevents electrification of the first filter wherein the cylinder part is insulated from the first filter by the first filter housing.

2. The fuel pump module of claim 1, further comprising:
a pressure regulating valve adjusting pressure of the fuel flowing through the first filter, wherein
the pressure regulating valve is in electrical connection with the antistatic unit.

3. The fuel pump module of claim 1, wherein
the antistatic unit is provided on a radially-inner portion of the first filter.

4. The fuel pump module of claim 1, wherein the antistatic unit is provided on a radially-outer portion of the first filter.

5. The fuel pump module of claim 1, wherein the antistatic unit is electrically connected to a negative terminal of a sender gauge that detects a fuel level in the fuel tank.

6. The fuel pump module of claim 1, wherein the first filter is formed from an insulating material.

7. The fuel pump module of claim 1, further comprising:

a first supply port disposed between (i) the first filter and (ii) the air-intake system into which the fuel is discharged from the first pump, the first supply port allowing the fuel filtered by the first filter to flow therethrough;

a second pump discharging the fuel in the fuel tank to a combustion chamber of the internal-combustion engine;

a second filter removing foreign substance from the fuel that is discharged from the second pump; and a second supply port disposed between the second filter and the combustion chamber, the second supply port allowing the fuel filtered by the second filter to flow therethrough.

8. The fuel pump module of claim 7, further comprising:

a second pump housing that houses the second pump and the second filter, wherein the first filter housing has a same shape as the second pump housing.

9. The fuel pump module of claim 1, wherein a connection part of the antistatic unit extends outside of the first filter housing to provide a conductive path from an interior of the first filter housing to an exterior of the first filter housing.

10. The fuel pump module of claim 9, wherein the connection part is electrically connected to the ground by way of an electrical connection outside of the first filter housing.

11. The fuel pump module of claim 9, wherein the connection part is electrically connected to the ground by way of a residual pressure maintenance valve and a ground line.

* * * * *